US007144337B2

(12) United States Patent
Hirano

(10) Patent No.: US 7,144,337 B2
(45) Date of Patent: Dec. 5, 2006

(54) IRON TYPE GOLF CLUB HEAD

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 190 days.

(21) Appl. No.: 10/968,036

(22) Filed: Oct. 20, 2004

(65) Prior Publication Data

US 2005/0101406 A1 May 12, 2005

(30) Foreign Application Priority Data

Nov. 10, 2003 (JP) ..... 2003-380217

(51) Int. Cl.
*A63B 53/04* (2006.01)

(52) U.S. Cl. ..... 473/342; 473/329; 473/350

(58) Field of Classification Search ..... 473/324–350
See application file for complete search history.

(56) References Cited

U.S. PATENT DOCUMENTS 6,348,013 B1 * 2/2002 Kosmatka ..... 473/329
6,428,426 B1 * 8/2002 Helmstetter et al. ..... 473/330
6,508,722 B1 * 1/2003 McCabe et al. ..... 473/330
6,605,007 B1 * 8/2003 Bissonnette et al. ..... 473/329
6,623,377 B1 * 9/2003 Evans et al. ..... 473/342
6,863,626 B1 * 3/2005 Evans et al. ..... 473/342
6,899,638 B1 * 5/2005 Iwata et al. ..... 473/329
6,960,142 B1 * 11/2005 Bissonnette et al. ..... 473/329
7,014,570 B1 * 3/2006 Evans et al. ..... 473/329
7,018,303 B1 * 3/2006 Yamamoto ..... 473/329
7,018,305 B1 * 3/2006 Sugimoto ..... 473/342
7,029,403 B1 * 4/2006 Rice et al. ..... 473/329
7,041,003 B1 * 5/2006 Bissonnette et al. ..... 473/329
2005/0101406 A1 * 5/2005 Hirano ..... 473/342
2006/0116219 A1 * 6/2006 Hirano ..... 473/350

FOREIGN PATENT DOCUMENTS

JP 2001-29523 A 2/2001
JP 2001-129131 A 5/2001

* cited by examiner

*Primary Examiner*—Eugene Kim
*Assistant Examiner*—Alvin A. Hunter, Jr.
(74) *Attorney, Agent, or Firm*—Birch, Stewart, Kolasch and Birch, LLP

(57) ABSTRACT

An iron type golf club head is provided with an annular trench including: an upper side trench portion that is positioned above the horizontal border line on the face surface through the sweet spot; and a lower side trench portion that is positioned beneath the above described border plane, and a ratio (Wu/Wd) of the average trench width Wu of the upper side trench portion to the average trench width Wd of the lower side trench portion is in the range of 2.5 to 5.0.

5 Claims, 6 Drawing Sheets

IRON TYPE GOLF CLUB HEAD

This Nonprovisional application claims priority under 35 U.S.C. § 119(a) on Patent Application No(s). 2003-380217 filed in Japan on Nov. 10, 2003, the entire contents of which are hereby incorporated by reference.

BACKGROUND OF THE INVENTION

The present invention relates to an iron type golf club head that is helpful to gain a large carry.

Conventionally, the orientation of a hit ball and the ease of lifting a ball has been thought more important than on the carry of a hit ball where an iron type golf club is concerned. However, in recent years, the technology for wood type golf clubs has improved, significantly increasing carry, and therefore, the difference in carry between iron type golf clubs and wood type golf clubs has been enlarged. As a result of this, recently, many golfers tend to place importance on the function also of iron type golf clubs in terms of carry.

In order to increase the function of golf clubs in terms of carry, it is considered to be effective to increase the coefficient of restitution of the head. The prior arts of Japanese published patent application No. 2001-129131, and No. 2001-29523 are examples, and describe that a dent or the like is provided on the back side of the face portion which hits a ball, so that a portion having a small thickness is provided.

However, there are many restrictions about a the head shape and the thickness of an iron type golf club head in comparison with a wood type golf club head, and it is not easy to increase the coefficient of restitution of an iron type golf club head.

An increase in the coefficient of restitution is a factor for increasing the initial speed of a hit ball, while the carry of the hit ball is not actually determined exclusively by the coefficient of restitution, but rather is significantly affected by the angle of the hit ball and the amount of backspin. In addition, the above described angle of the hit ball and the amount of backspin change depending on the point of the face where the ball is hit, thus, causing a variation in the carry.

Accordingly, it becomes important in order to gain a stable large carry, that a carry in the case where the hitting point of the face is shifted upward or downward from the sweet spot does not cause so different carry in comparison with the case where the hitting point is on the sweet spot of the face.

SUMMARY OF THE INVENTION

It is therefore, an object of the invention is to provide an iron type golf club head that makes it possible to gain a carry that is not so different from the case where the sweet spot hits a ball even in the case where the point of the face which hits a ball is shifted upward or downward from the sweet spot.

According to the present invention, a first aspect of the present invention is to provide an iron type golf club head in which an annular trench surrounding a central region that includes the sweet spot is provided on the back surface of the face portion, characterized in that, in the standard condition wherein the head is placed on a horizontal surface with prescribed lie angle and loft angle, the trench includes:

an upper side trench portion that is positioned above the horizontal border line on the face surface through the point(sweet spot) by which the face surface and a line passing through the center of gravity of the head and right-angled to the face surface crosses; and a lower side trench portion that is positioned beneath the above described border plane, and in that the ratio (Wu/Wd) of the average trench width Wu of the above described upper side trench portion to the average trench width Wd of the above described lower side trench portion ranges from 2.5 to 5.0.

In the head of the present invention, the average trench width of the upper side trench portion in the trench is increased so as to secure a large range of a thin head portion region above the above described border plane in the face portion, and thereby, the rigidity of this region is relatively reduced in the head. As a result of this, in the case where a point above the sweet spot of the face surface hits a ball, a recoil effect is strongly exhibited in the ball so that the amount of backspin thereof can be reduced. Thus, even when the angle of the hit ball is large, the height of flight can be reduced, gaining a large carry.

Contrarily, the average trench width of the lower side trench portion in the trench is reduced so as to provide a thin head portion region in a small range below the above described border plane, and thereby, a reduction in the rigidity of this region is restricted. As a result of this, even in the case where a point on the face surface beneath the sweet spot hits a ball, the amount of backspin of the ball is increased and even a small angle of the hit ball allows the ball to gain a large carry. In addition, the center region that includes the sweet spot is surrounded by the annular trench, and therefore, the entirety of this center region is flexed due to the trench, and thereby, a large carry can be gained in the case where the sweet spot hits a ball.

Furthermore, the limitation of the numerals wherein the ratio (Wu/Wd) of the average trench width Wu of the upper side trench portion to the average trench width Wd of the lower side trench portion ranges from 2.5 to 5.0, allows the control of the above described amount of backspin to be suitably modified even in the case where a point above or below the sweet spot hits a ball, and thus, a effect can be expected, such that the reduction in the carry can be reduced in comparison with the case where the sweet spot hits a ball.

DESCRIPTION OF THE PREFERRED EMBODIMENTS

In the following, the preferred embodiments of the present invention are described in reference to the drawings.

Figure 1:
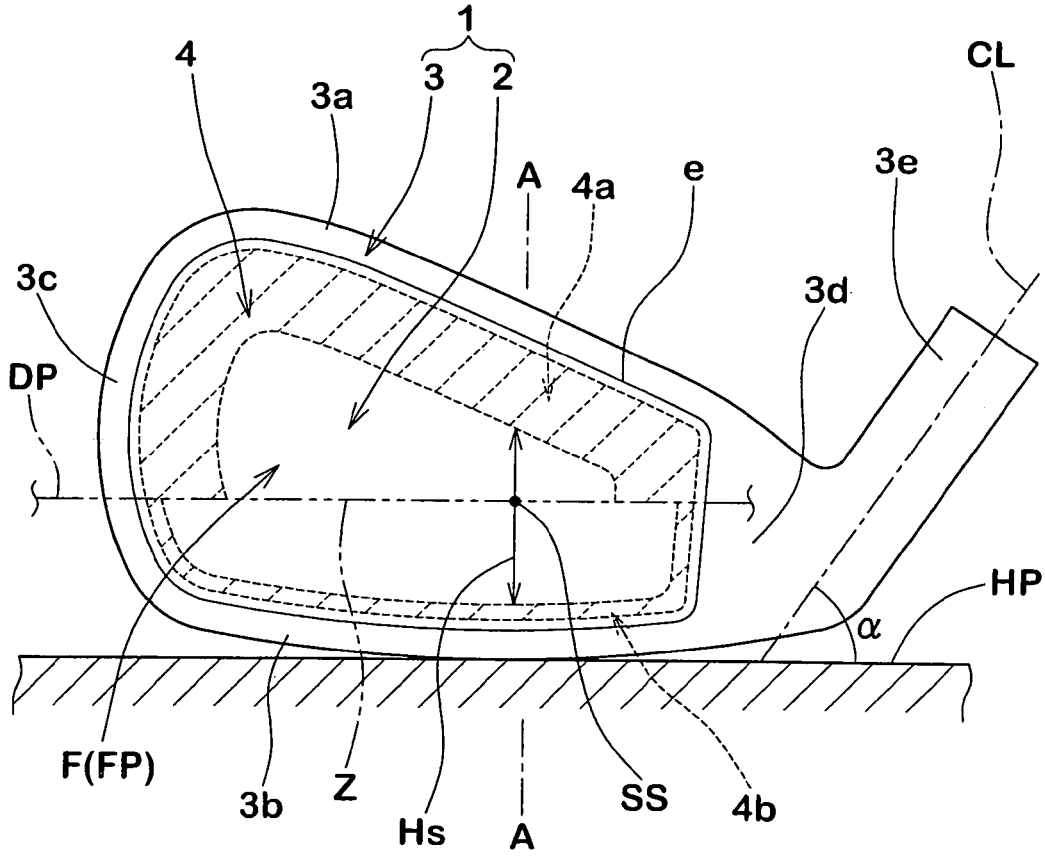
FIG. 1 is a front view showing an iron type golf club head according to one embodiment of the present invention.
Figure 2:
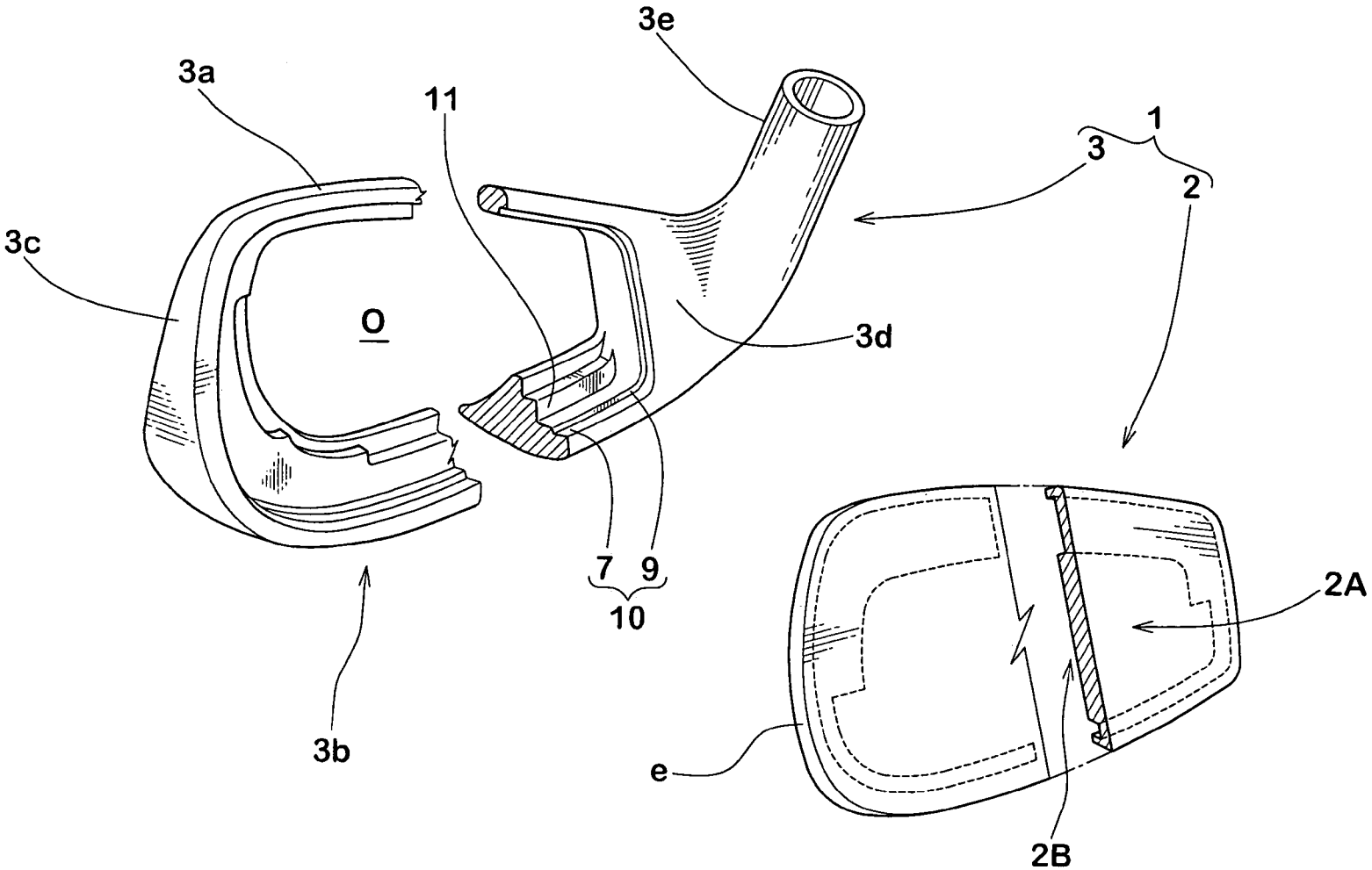
FIG. 2 is an exploded perspective view of the iron type golf club head.
Figure 3:
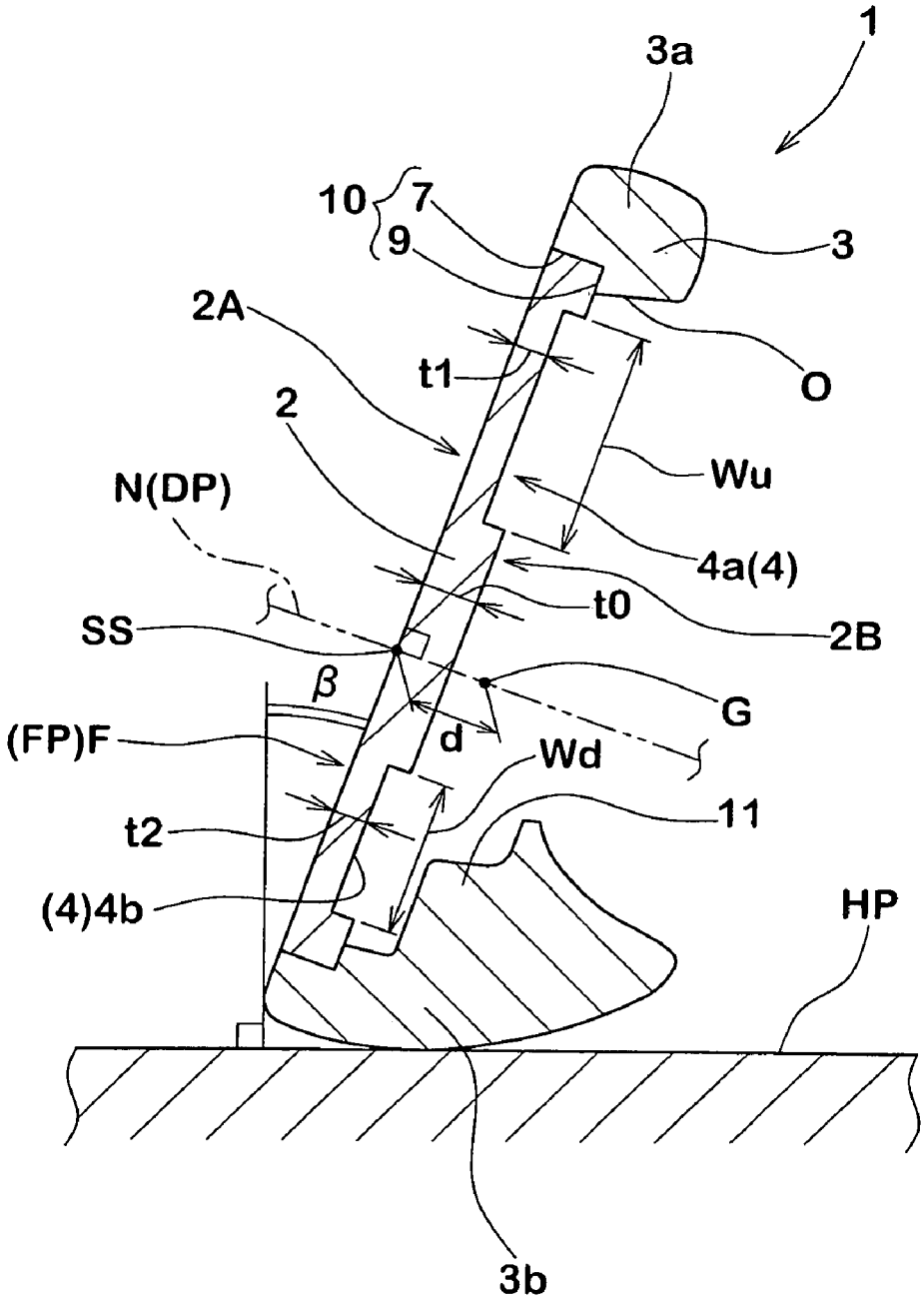
FIG. 3 is a cross-sectional view along A—A of FIG. 1.

FIG. 1 is a front view of an iron type golf club head in the standard condition according to one embodiment of the present invention; FIG. 2 is an exploded perspective view thereof; and FIG. 3 is an enlarged end view of a cross-section along line A—A of FIG. 1. An iron type golf club head (which may hereinafter simply be referred to as "head") 1 according to the present embodiment is formed of a face member 2 in plate form that forms at least a portion (the main portion in this example) of a face surface F that hits a ball, and a head body portion 3 having this face member 2 arranged on the front surface, as illustrated in the respective drawings. Here, the above described "standard condition" is a condition where the head 1 is placed on a horizontal surface HP when the lie angle a and loft angle b (real loft angle) are set at the values prescribed for this head.

As shown in FIG. 2, the head body portion 3 includes, for example: a top portion 3*a* that forms an upper portion of the head; a sole portion 3*b* that forms a lower portion of the head; a toe portion 3*c* that connects the top portion 3*a* to the sole portion 3*b* on the toe end side of the head; a neck portion 3*d* that connects the top portion 3*a* to the sole portion 3*b* on the heel side of the head; and a shaft attachment portion 3*e* extending upward from this neck portion 3*d* into which a shaft, not shown, is inserted. Consequently, the head body portion 3 in the present example is formed of an opening O surrounded by the top portion 3*a,* the toe portion 3*c,* the sole portion 3*b* and the neck portion 3*d,* and the opening O is penetrating forward and backward. Though the material of the head body portion is not particularly limited, it is desirable for the head body portion 3 to be formed of, for example, stainless steel such as SUS 630, SUS 255 or SUS 450, or a metal material having a comparatively large specific gravity.

A face attachment portion 10 having a cross-section in step form is formed in the periphery of the opening O. This face attachment portion 10 includes: an inside surface 7 that faces, for example, the outer peripheral surface e of the face member 2, and that is engaged with this outer peripheral surface e; and an annular support surface 9 that forms a wall that stands toward the center of the head on the rear end side of this inside surface 7, and that supports the peripheral portion of the rear surface 2B of the face member 2. The inside surface 7 has substantially the same contour as the outer peripheral surface e of the face member 2, and has substantially the same depth as the thickness of the outer peripheral surface e.

In addition, the sole portion 3*b* of the head body portion 3 is provided with a back wall portion 11. As shown in FIG. 3, this back wall portion 11 stands in a position away from the back surface 2B of the face member 2 at a low height. Such a back wall portion 11 forms a cavity in pocket form between the back surface of the face member 2, and provides large weight in the rear of the head, helping to increase the depth d of the center of gravity of the head 1.

The face member 2 has a substantially flat surface 2A (though in some cases a narrow trench such as a face line may be provided) on the face surface F side, the back surface 2B which is the surface on the side opposite to this surface 2A, and the annular outer peripheral surface e which extends between these surfaces 2A and 2B. The outer peripheral surface e of the face member 2 is supported by the inside surface 7 provided on the face attachment portion 10 of the head body portion 3, and the peripheral portion of the back surface 2B is supported by the support surface 9 provided in the face attachment portion 10, respectively, so as to be attached to the attachment portion 10 by means of, for example, caulking, adhesive or other fixation means. As a result of this, the surface 2A of the face member 2 and the front surface of the head body portion 3 form a face portion FP that partitions the face surface F.

The face member 2 of the present embodiment is formed of a titanium alloy (e.g. Ti-6Al-4V). The titanium alloy has a small specific weight in comparison with the stainless steel or the like that may form the head body portion 3, and therefore, the weight of the head can be allocated more in the periphery of the face member 2, helping to increase the sweet area. Here, a material other than a titanium alloy, for example, SUS 450 (maraging steel) or the like, may of course be utilized for the face member 2.

Figure 4:
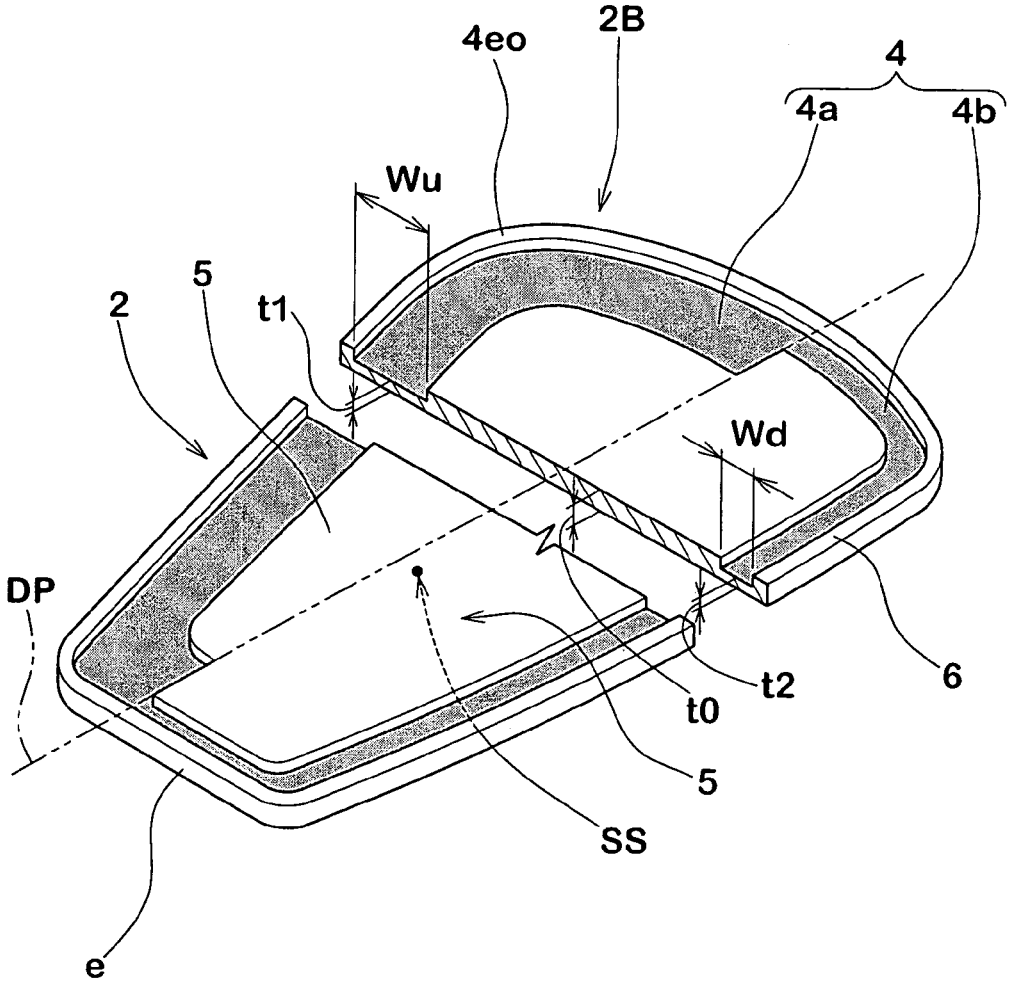
FIG. 4 is a perspective view of a face member viewed from the back surface side.

FIG. 4 shows the back surface 2B of the face member 2 that has been removed from the head. This back surface 2B is provided with a trench(dent) 4 that extends continuously in annular form. This trench 4 extends so as to surround the center region 5 that includes the sweet spot SS. In this example, the outer periphery 4*eo* of the trench 4 extends in a smooth manner along the outer peripheral surface e at a constant distance away from the outer peripheral surface e of the face member 2. A thick peripheral portion 6 is formed between the outer peripheral surface e and the outer periphery 4*eo*. This peripheral portion 6 is supported by the face attachment portion 10. The thicknesses t1 and t2 of the portions where the trench 4 is provided are smaller than the thickness t0 of the center region 5. Accordingly, the portion where the trench 4 is provided has a relatively small rigidity and becomes easily flexed at the time when the head hits a ball.

In addition, as shown in FIG. 3, the trench 4 includes: an upper side trench portion 4*a* that is positioned above the horizontal border line DP on the face surface F; an upper side trench portion 4*a* that is positioned above a border line DP and a lower side trench portion 4*b* that is positioned beneath the border line DP. The border line DP is a horizontal line on the face surface F through the point (sweet spot SS), by which the face surface F and a line N passing through the center G of gravity of the head 1 and right-angled to the face surface F crosses, in the "standard condition". As is clear from the drawing, the average trench width Wu of the upper side trench portion 4*a* is set at a value greater than that of the average trench width Wd of the lower side trench portion 4*b*.

In addition, according to the present invention, the ratio (Wu/Wd) of the average trench width Wu of the upper side trench portion 4*a* to the average trench width Wd of the lower side trench portion 4*b* is limited to a range between 2.5 and 5.0. An excellent working effect of such a head 1 at the time when the head hits a ball is gained by effectively utilizing a gear effect and a recoil effect in the vertical plane of an iron type golf club head.

Figure 6A:
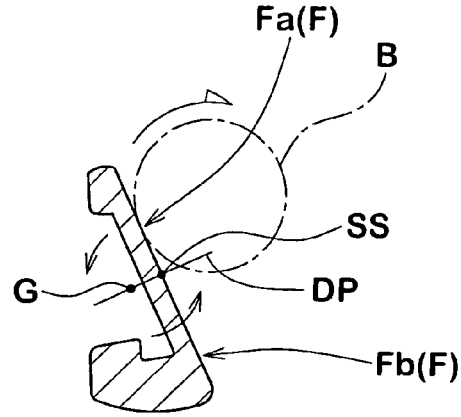
FIG. 6(A) and FIG. 6(B) are cross-sectional views illustrating the gear effect when a point on the upper and lower side, respectively, of the sweet spot SS hits a ball B.
Figure 6B:
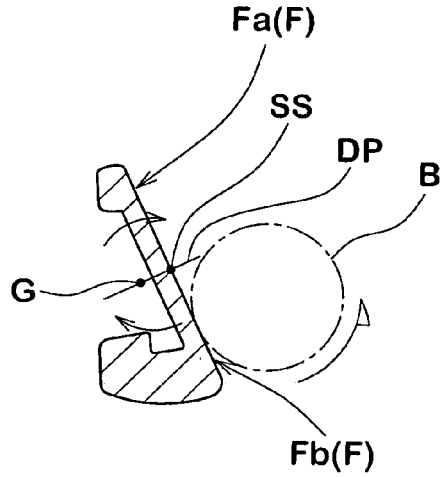

As shown in FIG. 6(A), in the case where, for example, a point on the upper side of the sweet spot SS on the face surface F hits a ball B, the head rotates counterclockwise in the figure around the center of gravity G of the head. This rotation increases the loft angle, thus increasing the apparent angle of the hit ball. In addition, a force in the direction opposite to the direction of rotation of the head is applied to the ball B due to the friction with the face surface F as if like a gear engagement as shown, and thus, the amount of backspin of the ball is reduced. In addition, as shown in FIG. 6(B), in the case where a point on the lower side of the sweet spot SS on the face surface F hits the ball B, the head rotates clockwise in the figure around the center of gravity G of the head. This rotation reduces the loft angle, thus reducing the apparent angle of the hit ball. In addition, a force in the direction opposite to the direction of rotation of the head is applied to the ball B, and therefore, the amount of backspin of the ball is increased. These effects are referred to as the upward and downward gear effects.

Figure 7:
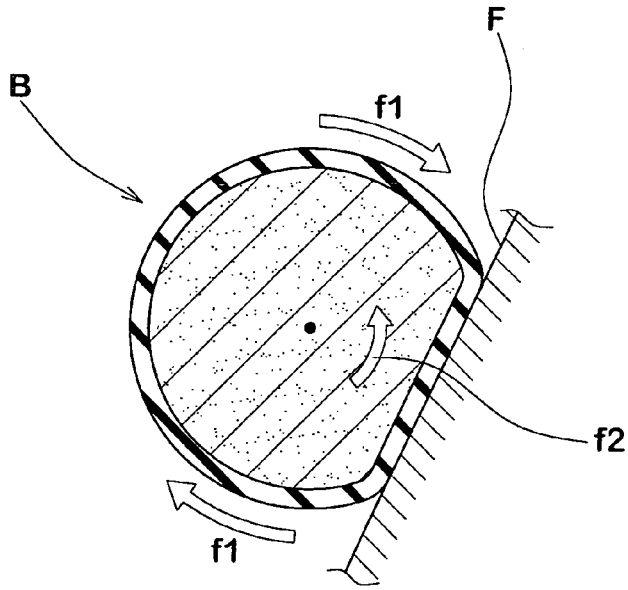
FIG. 7 is a cross-sectional view illustrating the recoil effect at the time when a ball is hit.

In addition, it is known that the restitution of the face portion FP is increased when the rigidity of the face portion is reduced (so-called as impedance matching theory). In the case where such a face portion FP hits a ball, the flexed amount due to the elastic transformation of the face portion FP increases, leading to an increase in the time of contact between the face surface F and the ball. As shown in FIG. 7, at the instance when the ball B makes contact with the face surface F, a force f1 that applies backspin occurs in the ball, while an internal friction f2 is applied to the inside of the ball B so that the ball is twisted in the direction opposite to the force f1. This has been clarified as a result of computer analysis in recent years, and such a phenomenon is referred to as a recoil effect. The greater the restitution of the head is, the more significantly the recoil effect is manifested. That is to say, the greater the restitution of the head is, the more intensely the internal friction f2 is applied, and as a result, the less the amount of backspin of the ball B.

In the case where a region Fa on the face surface, which is a region on the upper side of the border plane DP on the face surface F, hits a ball as shown in FIG. 6(A), the angle of the hit ball becomes large and the trajectory of the ball becomes too high, causing a high-flying ball, and thus, the ball easily stalls in the latter half of the flight, reducing the carry. Though the gear effects relatively reduce the amount of backspin, it is difficult to gain the backspin reducing effects that correspond to the amount of increase in the angle of the hit ball where an ordinal iron type golf club head is used.

Therefore, the average trench width Wu of the upper side trench portion 4*a* is made larger than the average trench width Wd of the lower side trench portion 4*b,* thereby reducing the rigidity of the upper region Fa of the face surface (an increase in the restitution) in the head 1 of the present invention. Accordingly, the time of contact between a ball and the face surface F can be lengthened at the time when the upper region Fa of the face surface hits the ball, and thereby, a high level of the internal friction f2 that accompanies the recoil effect can be greatly generated, thus making it possible to reduce the amount of backspin more effectively.

On the other hand, in the case where a lower region Fb of the face surface, which is a region on the lower side of the border plane DP of the face surface F, hits a ball as shown in FIG. 6(B), the angle of the hit ball becomes small, and the carry tends to be reduced due to the lack of height of the hit ball, in the case where a sufficient amount of backspin is not gained. Though a certain degree of increase in the amount of backspin can be expected due to the gear effects, it is difficult, in practice, to gain the backspin increasing effect which corresponds to the amount of the reduced angle of the hit ball, when a ordinal type iron golf club head is used.

In the head 1 of the present invention, the average trench width Wd of the lower side trench portion 4*b* is made smaller than the average trench width Wu of the upper side trench portion 4*b,* thus relatively increasing the rigidity of the lower region Fb of the face surface (no increase in the restitution). Accordingly, the time of contact between the ball and the face surface F is shortened as much as possible at the time when the lower region Fb of the face surface hits the ball, and the friction f2 inside the ball that accompanies the recoil effect is restricted, and thereby, the reduction in the amount of backspin can further be prevented. Here, in the case where the rigidity of the lower region Fb of the face surface is enhanced, by completely eliminating the lower side trench portion 4*b,* the rigidity of the center region 5 that includes the sweet spot SS is also enhanced, and as a result, an increase in the carry cannot be expected at the time, even when the sweet spot hits a ball, failing to achieve an object of the present invention.

As described above, the average trench widths Wu and Wd of the trench 4 with the border plane DP are made to be different from each other, and thereby, the gear effects and the recoil effect are effectively matched, making it possible to gain a maximum carry as a whole even in the case where a point which is shifted upward or downward from the sweet spot SS hits the ball. Next, the technical reason for limiting the numeral of the ratio (Wu/Wd) of the above described average trench widths is described.

The inventors conducted carry tests by preparing a variety of iron type golf clubs of the same type as that of FIG. 1, where the ratio (Wu/Wd) of the above described average trench widths is varied. In the tests, a swing robot was utilized, and the average carries were compared between the case where the sweet spot SS of the face surface F hit 50 balls and the case where a point that is shifted upward or downward from the sweet spot SS by 8 mm (in these tests, shots missed by a comparatively large margin are assumed) hit respective 50 balls (upward and downward from the sweet spot SS).

Figure 5:
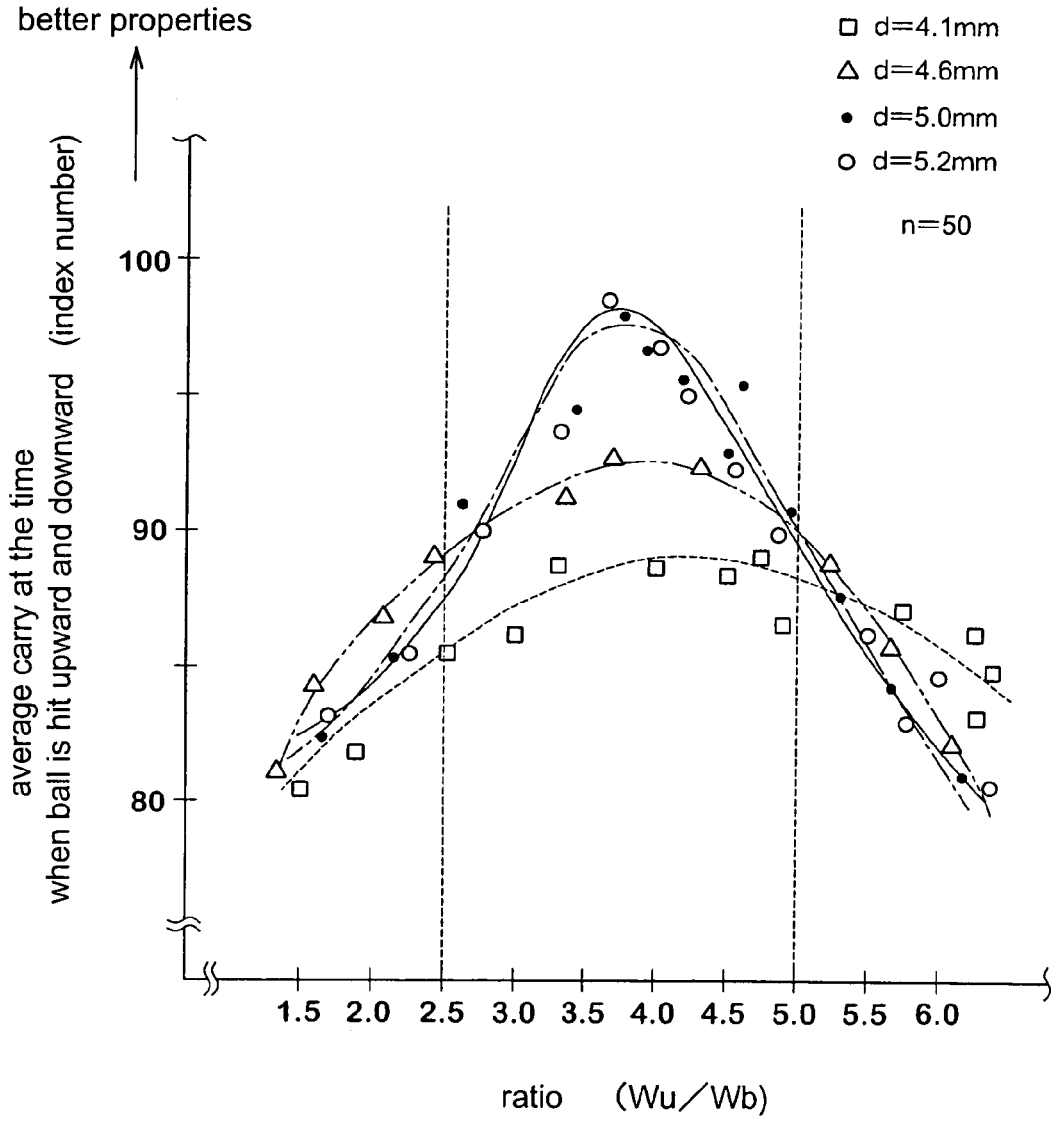
FIG. 5 is a graph showing the relationships between the average carries and the ratios (Wu/Wd) at the times when a ball is hit upward and downward.

FIG. 5 shows the results of the carry tests. The carries of the balls hit upward and downward are indicated by the index numbers when the average carry of the balls hit by the sweet spot is 100, indicating that the greater the numeral value is, the smaller the loss in carry is. As is clear from the figure, in the case where the ratio (Wu/Wd) is approximately 1.5, a loss in carry of approximately 20% occurs for the balls hit upward or downward in comparison with the case of the balls hit by the sweet spot. However, when the above described ratio is increased to 2.5, a significant effect is gained, where the loss in carry can be reduced to 10% to 15%, and it is clear that this becomes a great merit for golfers having an average skill level. In order to restrict the loss in carry to approximately 10% or less, it is necessary to hold the upper limit of the above described ratio (Wu/Wd) at 5.0. When the ratio exceeds 5.0, the loss in carry is again increased.

It should be specially mentioned that a further limitation of the ratio (Wu/Wd) and the depth d of the center of gravity of the head 1 are related to each other. Concretely speaking, it is preferable for the lower limit of the ratio (Wu/Wd) to be 2.5 or higher, preferably 3.0 or higher and it is more preferable for the lower limit to be 3.5 or higher. It is preferable for the upper limit to be 5.0 or less, preferable 4.4 or less when being combined with any of the lower limit values. In addition, it is desirable for the depth d of the center of gravity of the head 1 to be 4.6 or greater, preferably 5.0 mm or greater, and it is more preferable for the depth d to be 5.2 mm or greater. The combination of these parameters allows the above described working effects to occur in a so-called peak manner, and a critical effect can occur in such a manner that the loss in carry at the time of a ball hit upwardly or downwardly is restricted to approximately 5% (in case of 3.5–4.4% of the ratio (Wu/Wd), more than 5.2 mm depth d) of the case when the sweet spot hits a ball. It is inferred that this results from synergetic effects between the combined effects of the gear effects and the recoil effect gained by limiting the depth d of the center of gravity of the head 1 to a constant length, and the working effects gained by limiting the ratio (Wu/Wd) of the trench width to the above described value. Here, in the case where the depth d of the center of gravity of the head 1 is excessively increased, the head shape tends to be warped, and the weight of the head tends to increase significantly. It is preferable for the upper limit of the depth d of the center of gravity to be 7.0 mm or less when being combined with any of the above described lower limit values, and furthermore, it is more preferable for the upper limit to be 6.0 mm or less.

Here, though the thickness t0 of the center region 5 of the face member 2 is not particularly limited, it is preferable for the lower limit to be 2.5 mm or greater, and it is more preferable for the lower limit to be 2.7 mm or greater, while it is preferable for the upper limit to be 3.5 mm or less when being combined with any of the above described lower limits, and it is more preferable for the upper limit to be 3.2 mm or less. In the case where the thickness t0 is 2.5 mm or less, the durability of the center region 5 which is subjected to a large impact tends to be reduced, and contrarily, in the case where the thickness t0 exceeds 3.5 mm, the rigidity of the entirety of the face member 2 tends to be enhanced, causing the restitution to be deteriorated. Though the thickness of this center region 5 of the present embodiment and of the above described tested clubs is a substantially uniform thickness of 3.0 mm, the thickness can be varied.

In addition, though the minimum thicknesses t0 and t2 in the upper side trench portion 4*a* and lower side trench portion 4*b* of the face member 2 are not particularly limited, it is preferable for the lower limit of the thickness t1 to be 1.6 mm or greater, and it is more preferable for the lower limit to be 1.7 mm or greater, while it is preferable for the upper limit of the thickness t1 to be 2.3 mm or less when being combined with any of the lower limits, and it is more preferable for the upper limit to be 2.0 mm or less. In addition, it is preferable for the lower limit of the thickness t2 to be 1.8 mm or greater, and it is more preferable for the lower limit to be 2.0 mm or greater, while it is preferable for the upper limit of the thickness t2 to be 2.5 mm or less when being combined with any of the above described lower limits, and it is more preferable for the upper limit to be 2.3 mm or less.

In the case where the thickness t1 is 1.6 mm or less or the thickness t2 is 1.8 mm or less, the strength in the trench 4 tends to lack, causing the durability of the face portion FP to be reduced. Contrarily, in the case where the above described thickness t1 is greater than 2.3 mm or the thickness t2 is greater than 2.5 mm, it becomes difficult to control the rigidity of the upper region Fa or the lower region Fb of the face surface. In the present embodiment and in the above described tested clubs, the thickness t1 in the upper side trench portion 4*a* is set at 1.8 mm and the thickness t2 in the lower side trench portion 4*b* is set at 2.3 mm, which are both substantially uniform in thickness.

In addition, in the case where an iron type golf club head having a conventional size is assumed to be used, it is preferable for the lower limit of the average trench width Wu of the upper side trench portion 4*a* to be 3.0 mm or greater, and it is more preferable for the lower limit to be 4.0 mm or greater. In addition, it is preferable for the upper limit of the average trench width Wu of the upper side trench portion 4*a* to be 15.0 mm or less when being combined with any of the above described lower limits, and it is more preferable for the upper limit to be 12.0 mm or less. In the case where the average trench width Wu of the upper side trench portion 4*a* is 3.0 mm or less, it becomes difficult to sufficiently gain the effects of reducing the rigidity of the upper region Fa of the face surface, leading to the tendency where it is difficult to achieve a high level of the recoil effect. Contrarily, in the case where the average trench width exceeds 15.0 mm, the rigidity of the upper region Fa of the face surface tends to be excessively reduced, causing the durability to be deteriorated.

In the same manner, it is preferable for the lower limit of the average trench width Wd of the above described lower side trench portion 4*b* to be 1.0 mm or greater, and it is more preferable for the lower limit to be 3.0 mm or greater. In addition, it is preferable for the upper limit of the average trench width Wd of the lower side trench portion 4*b* to be 7.0 mm or less when being combined with any of the above described lower limits, and it is more preferable for the upper limit to be 5.0 mm or less. In the case where the average trench width Wd of the lower side trench portion 4*b* is 1.0 mm or less, the rigidity of the center region 5 tends to increase, making it difficult to expect an increase in the carry at the time when the sweet spot hits a ball. Contrarily, in the case where the average trench width exceeds 7.0 mm, the rigidity of the lower region Fb of the face surface tends to be reduced, allowing the recoil effect to occur to a exessive degree.

In the present embodiment and in the above described tested clubs, each of the trench widths Wu, Wd of the upper side trench portion 4*a* and the lower side trench portion 4*b* is substantially constant. Though the trench width naturally may vary, in the case where the trench width varies, it is preferable for each of the upper side trench portion 4*a* and lower side trench portion 4*b* to have a trench width that varies by a small amount in a manner where the difference between the maximum trench width and the minimum trench width is within 3 mm. In addition, in the case where the trench width varies, the above described average trench width Wu (Wd is also calculated in the same manner), for example, is calculated by weighing according to the length thereof, as described below:

$$Wu=\Sigma(Wui\bar{7}Li)/SLi(i=1,2,)$$

where Wui indicates the trench width of an arbitrary region i of the upper side trench portion 4*a,* and Li indicates the length occupied by the above described trench width Wui.

In addition, it is desirable for the center region 5 to have a length Hs in the upward and downward directions along the face surface F passing through the sweet spot SS of 15 mm or greater in the above described standard condition. In the case that the length is 15 mm or less, the thin head portion region, due to the trench 4, tends to be too wide, and as a result, the durability is deteriorated. In addition, it is desirable for the length Hs of the center region 5 to be 35 mm of less. In the case that the length exceeds 35 mm, the thin head portion region tends to be reduced, making the control of the rigidity difficult. In particular, it is preferable for the lower limit of the length Hs to be 20 mm or greater, and it is more desirable for the upper limit to be 30 mm or less.

In addition, in order to respectively adjust the rigidities of the upper region Fa of the face surface and the lower region Fb of the face surface to more preferable values, it is preferable for the ratio (Su/Sd) of the trench area Su of the upper side trench portion 4*a* in the trench 4 to the trench area Sd of the lower side trench portion 4*b* to be 2.0 or greater, it is more preferable for the ratio to be 2.3 or greater, and it is still more preferable for the ratio to be 2.5 or greater, while it is preferable for the upper limit of the ratio to be 3.5 or less, it is more preferable for the upper limit to be 3.0 or less, and it is still more preferable for the upper limit to be 2.8 or less.

Though the border portion between the upper side trench portion 4*a* and the lower side trench portion 4*b* in the trench width varies in step form in the embodiment shown in FIG. 4, the present invention is not limited to such an embodiment, but rather, the trench width may vary in a smooth manner. In addition, though the trench corners at the bottom and the at the upper side are in the form of sharp edge, it is naturally possible to cut off or curved including round corners. In addition, though the face member 2 and the head body portion 3 made of different materials are integrated into the form according to the present embodiment, it may of course be an integrated mold unit.

EXAMPLES

Iron type golf club heads having a loft angle of 25—were prototyped based on Table 1 and FIG. 1. Each head was formed of a head body portion made of an SUS 630 lost wax casting, to which a face member made of a plate of 6Al-4V-Ti was press-fit. A trench provided on the back surface of the face member was processed by using an NC machine. In each prototype, the upper side trench and the lower side trench were both created so as to have substantially constant trench widths respectively as shown in FIG. 4.

An identical shaft was attached to each prototype head so as to manufacture an iron type golf club of which the entire length was 38.0 inches. Each club was attached to a swing robot, and the three points in total, the sweet spot and the points 5 mm above and below the sweet spot (in this test, shots missed by a comparatively small amount were assumed) hit the balls at a head speed of 34.5 m/s, in a manner that the angle of the hit ball, the amount of backspin and carry were respectively measured.

The results of the test are shown in Table 1.

The invention claimed is:

1. An iron type golf club head having a face portion in which an annular trench surrounding a central region that includes a sweet spot is provided on the back surface of the face portion, characterized in that, in the standard condition wherein the head is placed on a horizontal surface with prescribed lie angle and loft angle, said trench includes:

an upper side trench portion that is positioned above a horizontal border line on a face surface through the sweet spot by which the face surface and a line passing through a center of gravity of the head and right-angled to the face surface crosses; and a lower side trench portion that is positioned beneath the horizontal border line, and in that a ratio (Wu/Wd) of the average trench width Wu of said upper side trench portion to the average trench width Wd of the lower side trench portion is 2.5 to 5.0.

2. The iron type golf club head according to claim 1, wherein the average trench width Wu of the upper side trench portion is 3.0 mm to 15.0 mm and the average trench width Wd of the lower side trench portion is 1.0 mm to 7.0 mm, and wherein a depth of the center of gravity is 5.0 mm or greater.

3. The iron type golf club head according to claim 1, wherein a thickness t1 of the face portion in the upper side trench portion is 1.6 mm to 2.3 mm and a thickness t2 of the face portion in the lower side trench portion is 1.8 mm to 2.5 mm, and wherein a thickness t0 of the center portion region is 2.5 mm to 3.5 mm.

TABLE 1

| | | | Example 1 | Example 2 | Example 3 | Comparative Example 1 | Comparative Example 2 | Comparative Example 3 |
|---|---|---|---|---|---|---|---|---|
| Specifications of face portion | | Thickness t0 of center region [mm] | 3.0 | 3.0 | 3.0 | 3.0 | 3.0 | 3.0 |
| | | Thickness t1 at upper side trench portion [mm] | 2.0 | 2.0 | 2.0 | 2.0 | 2.0 | 2.0 |
| | | Average trench width Wu of upper side trench portion [mm] | 6.3 | 6.5 | 6.15 | 2.5 | 6.0 | 6.0 |
| | | Thickness t2 at lower side trench portion [mm] | 2.2 | 2.2 | 2.2 | 2.2 | 2.2 | 2.2 |
| | | Average trench width Wd of lower side trench portion [mm] | 1.8 | 1.5 | 2.45 | 7.0 | 6.0 | 3.0 |
| | | Length HS [mm] | 28.0 | 29.0 | 31.5 | 27.5 | 20.0 | 27.0 |
| | | Ratio (Wu/Wd) | 3.5 | 4.3 | 2.5 | 0.35 | 1.0 | 2.0 |
| | | Ratio (Su/Sd) | 2.5 | 2.7 | 3.0 | 0.40 | 1.2 | 1.8 |
| | Depth d of center of gravity [mm] | | 5.5 | 5.5 | 5.5 | 5.3 | 5.5 | 5.3 |
| Test results | Carry | Carry of ball hit upward [m] | 170.1 | 170.3 | 169.9 | 167.3 | 169.5 | 169.5 |
| | | Carry of ball hit by sweet spot [m] | 171.4 | 171.5 | 171.5 | 171.5 | 171.5 | 171.4 |
| | | Carry of ball hit downward [m] | 166.5 | 166.8 | 166.3 | 162.1 | 163.8 | 166.0 |
| | | Average | 169.3 | 169.5 | 169.2 | 167.0 | 168.3 | 168.9 |
| | | Maximum value of difference in carry [m] | 4.9 | 4.7 | 5.2 | 9.4 | 7.7 | 6.5 |
| | Amount of backspin | Amount of backspin of ball hit upward [rpm] | 3349 | 3343 | 3348 | 3318 | 3355 | 3422 |
| | | Amount of backspin of ball hit by sweet spot [rpm] | 3590 | 3595 | 3600 | 3587 | 3608 | 3591 |
| | | Amount of backspin of ball hit downward [rpm] | 3720 | 3755 | 3701 | 3343 | 3635 | 3610 |
| | Angle of hit ball | Angle of ball hit upward [deg] | 15.9 | 15.9 | 16.0 | 15.6 | 15.6 | 16.0 |
| | | Angle of ball hit by sweet spot [deg] | 15.1 | 15.3 | 15.3 | 15.2 | 15.2 | 15.3 |
| | | Angle of ball hit downward [deg] | 14.5 | 14.6 | 14.5 | 14.2 | 14.3 | 14.5 |

As a result of the test, significant effects of the examples could be confirmed.

4. The iron type golf club head according to claim 1, wherein a ratio (Su/Sd) of a trench area Su of the upper side trench portion to a trench area Sd of the lower side trench portion is 2.0 to 3.5 in the trench.

5. The iron type golf club head according to claim 1, wherein a length of the center region in the upward and downward directions that includes a sweet spot along the face surface is 15 mm to 35 mm in the standard condition.

* * * * *